United States Patent [19]

Konagai et al.

[11] Patent Number: 4,473,748

[45] Date of Patent: Sep. 25, 1984

[54] NEUTRAL PARTICLE ANALYZER

[75] Inventors: Chikara Konagai; Shimpey Shirayama; Iwao Miura, all of Yokohama; Toyoaki Kimura, Ibaraki; Tohru Matoba, Ibaraki; Hiroshi Takeuchi, Ibaraki, all of Japan

[73] Assignees: Tokyo Shibaura Denki Kabushiki Kaisha, Kawasaki; Japan Atomic Energy Research Institute, Tokyo, both of Japan

[21] Appl. No.: 356,727

[22] Filed: Mar. 10, 1982

[30] Foreign Application Priority Data

Mar. 18, 1981 [JP] Japan ..... 56-39090

[51] Int. Cl.[3] ..... H01J 49/30

[52] U.S. Cl. ..... 250/299

[58] Field of Search ..... 250/299, 370, 251, 288, 250/297, 296, 397

[56] References Cited

U.S. PATENT DOCUMENTS

| | | | |
|---|---|---|---|
| 3,517,191 | 6/1970 | Liebl | 250/296 X |
| 3,872,287 | 3/1975 | Koeman | 250/370 X |
| 4,320,295 | 3/1982 | Eloy | 250/397 X |

OTHER PUBLICATIONS

Lamport et al., "A Large Area Circular Position Sensitive Si Detector", *Nuclear Instruments an Methods* 134, No. 1, Apr. 1976, pp. 71–76.

PPPL-1582, Study of the mass and energy resolution of the E″B charge exchange analyzer for TFTR, R. Kaita et al., Sep. 1979.

*Primary Examiner*—Alfred E. Smith
*Assistant Examiner*—Jack I. Berman
*Attorney, Agent, or Firm*—Oblon, Fisher, Spivak, McClelland & Maier

[57] ABSTRACT

A neutral particle analyzer has a stripping cell for converting a neutral beam into a charged particle beam, a momentum analyzer for deflecting paths of respective charged particles of the charged particle beam emerging from the stripping cell in correspondence with momenta thereof, and a semiconductor energy analyzer comprising a plurality of semiconductor detectors which are arranged in the paths of deflected charged particle beams emerging from the momentum analyzer. The semiconductor energy analyzer generates pulse signals having pulse heights corresponding to masses of and kinetic energies of the deflected charged particles of the deflected charged particle beams.

6 Claims, 8 Drawing Figures

NEUTRAL PARTICLE ANALYZER

BACKGROUND OF THE INVENTION

The present invention relates to a neutral particle analyzer for performing mass analysis, energy analysis, and detection of particle numbers of electrically neutral particles, for example, neutral hydrogen particles.

More studies have been recently made on nuclear fusion. Nuclear fusion is defined as a fusion reaction of deuteron ($D^+$) or triton ($T^+$) in a plasma at ultra-high temperatures. Particles such as $H^+$, $D^+$, $T^+$ and electrons are present in the plasma. However, $H^+$, $D^+$ and $T^+$ are recoupled with electrons to produce electrically neutral H, D and T. It is possible to determine the ion density or temperature in the plasma by extracting these neutral particles from the plasma and by analyzing or detecting the mass, energy or particle number thereof.

An apparatus as shown in FIG. 1 is conventionally known for analysis of neutral particles. Referring to FIG. 1, a charge exchanging section 1 comprises a vacuum envelope 2; a stripping cell 3 arranged inside the vacuum envelope 2; a gas supply source 4 for feeding nitrogen gas or hydrogen gas to the stripping cell 3; and a vacuum pump 6 for evacuating the gas inside the envelope 2 through evacuating parts 5*a* and 5*b* formed at the envelope 2 so as to keep the interior of the envelope 2 at a vacuum of high order. A momentum analyzer 7 is arranged in the proximity of the charge exchanging section 1 of this apparatus. The momentum analyzer 7 comprises a magnet for inducing a magnetic field which is perpendicular to the path of positive particles from the charge exchanging section 1. A plurality of energy analyzers 8*a* to 8*e* is arranged in the path of the positive particles from the momentum analyzer 7. Each energy analyzer comprises a pair of concentric arc-shaped electrode plates 14*s* and 14*t*, and a power source (not shown) for applying a voltage to these electrode plates 14*s* and 14*t*. The radius of curvature of the electrode plates differs from one energy analyzer to another. Ion detectors 9*a* to 9*e* are arranged at later stages of the energy analyzers 8*a* to 8*e* in correspondence therewith. These ion detectors 9*a* to 9*e* generate pulse signals corresponding to the number of charge particles received. The atmospheres around the momentum analyzer 7, the energy analyzers 8*a* to 8*e*, and the ion detectors 9*a* to 9*e* are evacuated by the vacuum pump 6.

With a conventional neutral particle analyzer of this configuration, the measurement of the neutral particles is performed as follows.

A neutral particle beam 11 which becomes incident on the charge exchanging section 1 is converted into a positive charged particle beam 12 with the orbital electrons removed but with the momentum and kinetic energy of the individual particles remaining constant. The positive charged particle beam 12 then becomes incident on the momentum analyzer 7 which deflects the particles with radii of curvature proportional to the momenta of the individual particles and which produces particle beams 13*a* to 13*e* emerging on different paths.

Taking the particle beam 13*a* which is deflected with the smallest radius of curvature as an example among the particle beams 13*a* to 13*e*, this particle beam 13*a* consists of particles which have the same momentum but which have different energies according to their particle masses. If the particle beam 13*a* contains protons ($H^+$), deuterons ($D^+$) and tritons ($T^+$), these particles will have the same momenta. Therefore, the energy of the deuterons is $\frac{1}{2}$ that of the protons and the energy of the tritons is $\frac{1}{3}$ that of the protons. In order to analyze particles of the particle beam having different particle energies, it is necessary to select a suitable voltage to be applied to the energy analyzer. Let $r_{in}$ and $r_{out}$ denote the radii of curvatures of the electrode plates 14*s* and 14*t* of the energy analyzer 8*a*, and let $-V$ and $+V$ denote voltages applied to the electrodes 14*s* and 14*t*; the energy E of the particles which pass through the energy analyzer can then be expressed by equation (1) below:

$$E=qV/ln\,(r_{out}/r_{in}) \qquad \ldots (1)$$

where q is the charge of the incident charged particles. As may be seen from equation (1) above, the energy of the particles analyzed is proportional to the voltage applied to the energy analyzer provided that the radii of curvature $r_{in}$ and $r_{out}$ of the electrode plates 14*s* and $14_t$ have predetermined values, that is, provided that the energy analyzer has a predetermined shape. Therefore, in the case of energy analysis of a particles beam containing particles proton, deuteron and triton, it is possible to perform energy analysis of the particles which have the same momentum but different masses by sequentially applying, in stepped forms, a voltage 15 which allows the passage of tritons, a voltage 16 which allows the passage of deuterons, and a voltage 17 which allows the passage of protons, as shown in FIG. 2.

In this manner, energy analysis of charged particles having different masses may be accomplished by guiding the particle beams 13*a* to 13*e* having different momenta from the momentum analyzer 7 to the corresponding energy analyzers 8*a* to 8*e*, and applying voltages, corresponding to the energies of particles having different masses, to the electrodes of the respective energy analyzers 8*a* to 8*e*, as shown in FIG. 2.

The particles which pass through the energy analyzers 8*a* to 8*e* then become incident on the ion detectors 9*a* to 9*e* which produce electric signals. In order to count the number of every type of particles, the ion detectors conveniently comprise secondary electron multiplier. In order to measure the energy intensity, the ion detectors conveniently comprise Faraday cups.

With a conventional neutral particle analyzer, the voltage to be applied to the energy analyzer must be varied to correspond to the mass of the particles to be analyzed as described above in order to obtain the energy distribution of the neutral particles having different masses. Therefore, the analysis time of the desired particles having a specific mass in the total analysis time is limited. Moreover, it is impossible to perform the simultaneous measurement of the energy distributions of the particles having different masses. Since the energy analyzers are large in size and must be arranged in arc-shapes, the number of analyzers which may be used is limited due to spatial factors. This results in a disadvantage of low energy resolution.

SUMMARY OF THE INVENTION

It is an object of the present invention to provide a neutral particle analyzer which is compact in size and high in energy resolution and which is capable of simultaneously measuring the energy distributions of particles having different masses.

In order to achieve this object, there is provided according to the present invention a neutral particle analyzer comprising: ionization means for converting a neutral beam into a charged particle beam; momentum analyzing means for deflecting paths of respective charged particles of the charged particle beam emerging from said ionization means in correspondence with momenta thereof; and a semiconductor energy analyzer comprising a plurality of semiconductor detectors which are arranged in the paths of deflected charged particle beams emerging from said momentum analyzing means, said semiconductor energy analyzer generating pulse signals having pulse heights corresponding to masses of and kinetic energies of the deflected charged particles of the deflected charged particle beams.

DETAILED DESCRIPTION OF THE PREFERRED EMBODIMENTS

Preferred embodiments of the present invention will now be described in detail with reference to the accompanying drawings.

Figure 1:
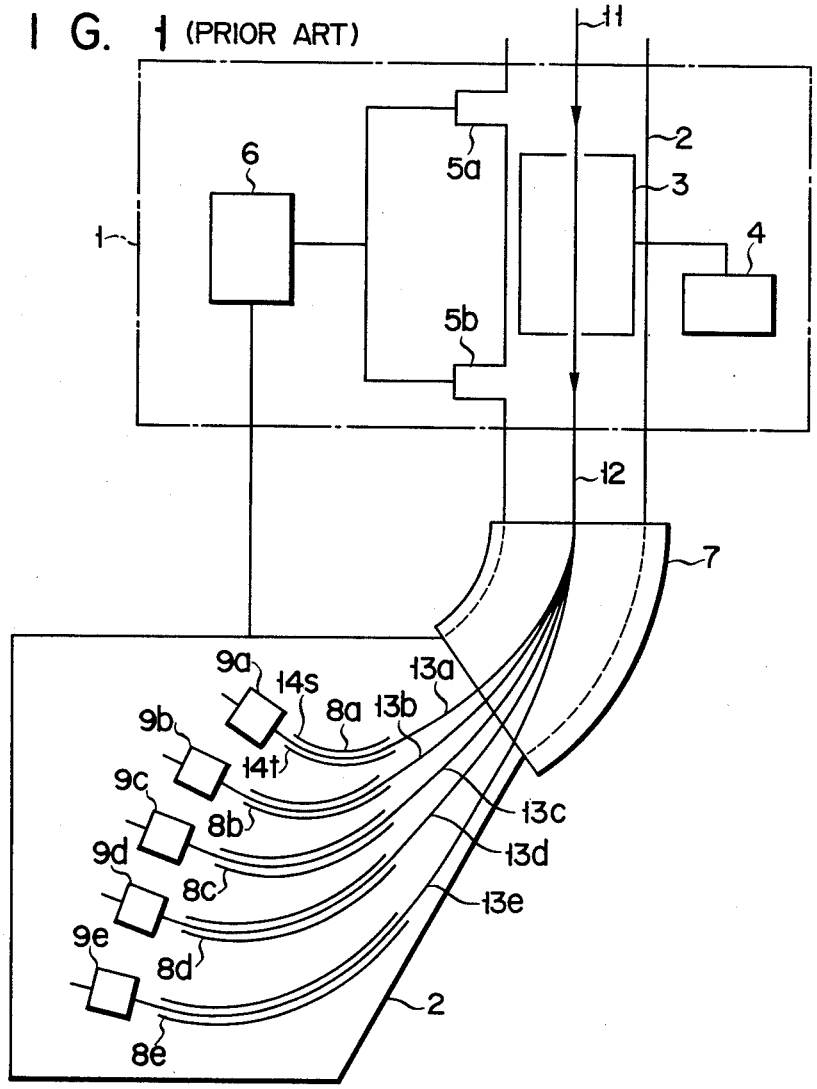
FIG. 1 (PRIOR ART)
FIG. 1 is a schematic view showing the configuration of a conventional neutral particle analyzer.
Figure 2:
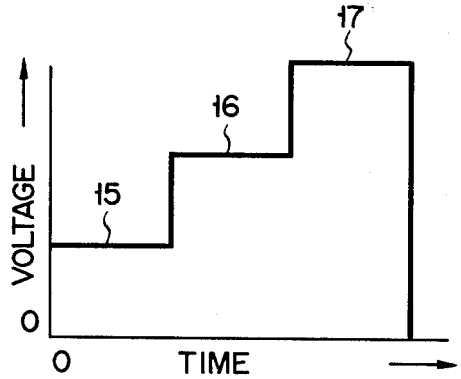
FIG. 2 (PRIOR ART)
FIG. 2 is a graph showing the relationship between time and a voltage applied to an energy analyzer in the neutral particle analyzer shown in FIG. 1.
Figure 3:
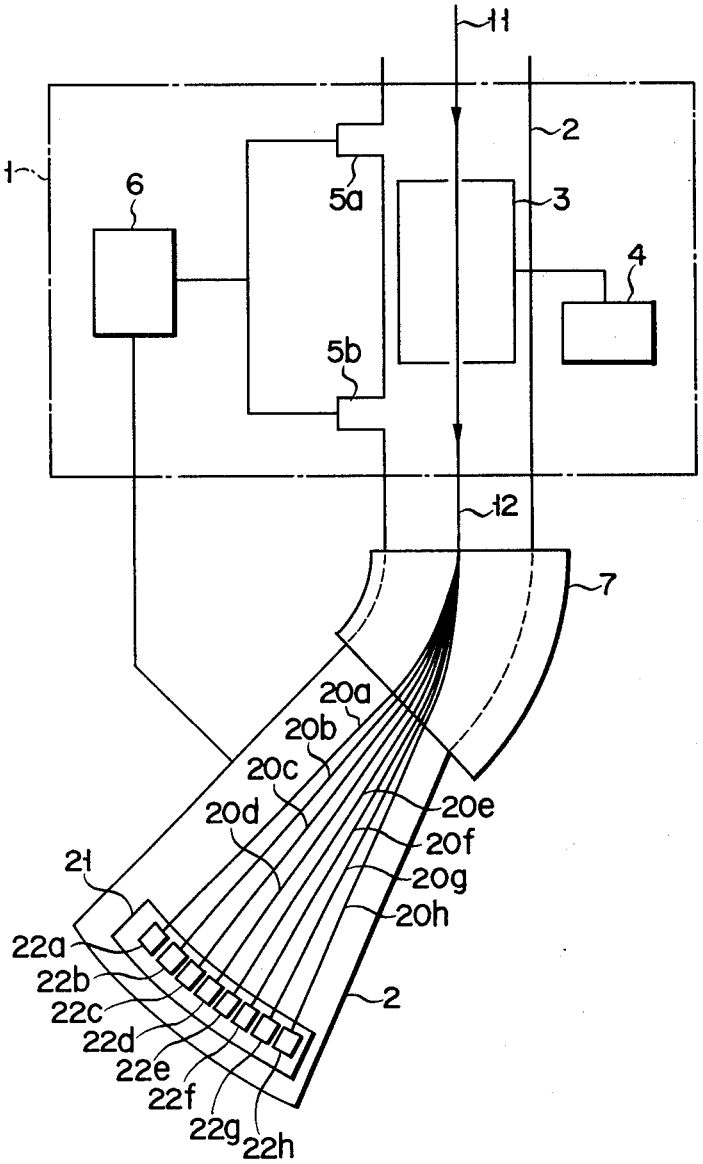
FIG. 3 is a schematic view showing the configuration of a neutral particle analyzer according to an embodiment of the present invention.

FIG. 3 schematically shows the configuration of a neutral particle analyzer according to an embodiment of the present invention. The same reference numerals in FIG. 3 denote the same parts as those of the analyzer shown in FIG. 1. Referring to FIG. 3, the charge exchanging section 1 comprises the vacuum envelope 2; the stripping cell 3 arranged inside the vacuum envelope 2; the gas supply source 4 for feeding nitrogen gas or hydrogen gas to the stripping cell 3; and the vacuum pump 6 for evacuating the gas inside the envelope 2 through evacuating ports 5*a* and 5*b* formed at the envelope 2 so as to keep the interior of the envelope 2 at a vacuum of high order. The momentum analyzer 7 is arranged in the proximity of the charge exchanging section 1 of this apparatus. The momentum analyzer 7 comprises a magnet for inducing a magnetic field which is perpendicular to the path of positive particles from the charge exchanging section 1. The neutral particle analyzer of the present invention has, so far, the same configuration as that of the conventional analyzer shown in FIG. 1. A semiconductor energy analyzer 21 is arranged in the paths of positive charged particle beams 20*a* to 20*h* which are deflected by the momentum analyzer 7. Thus, the positive charged particles become incident on the semiconductor energy analyzer 21. The atmosphere surrounding the momentum analyzer 7 and the semiconductor energy analyzer 21 are evacuated by the vacuum pump 6 as in the case of the analyzer shown in FIG. 1.

The semiconductor energy analyzer 21 comprises a plurality of surface barrier-type semiconductor detectors 22*a* to 22*h* which are arranged in an array so as to receive all of the positive charged particle beams 20*a* to 20*h*. The planes of incidence of the surface barrier-type semiconductor detectors 22*a* to 22*h* are preferably substantially perpendicular to the beams 20*a* to 20*h*.

Figure 4:
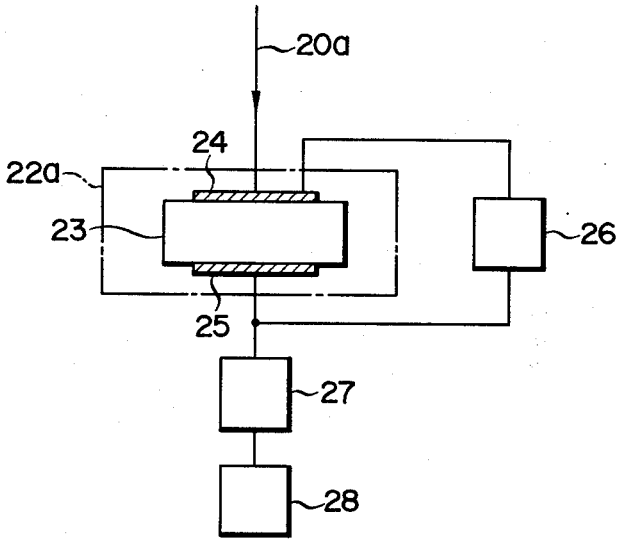
FIG. 4 is a view showing the configuration of a semiconductor detector of the analyzer shown in FIG. 3.

FIG. 4 shows an example of the configuration of the surface barrier-type semiconductor detector. The surface barrier-type semiconductor detector 22*a* comprises an n-type silicon substrate 23, a gold deposition layer 24 formed on the front surface thereof, and an aluminum deposition layer 25 formed on the back surface of the substrate. To this surface barrier-type semiconductor detector 22*a* are connected a power source 26 for applying a voltage to the deposition layers 24 and 25, an amplifier 27 for amplifying the output signal from the detector 22*a*, and a pulse-height analyzer 28. The deposition layer 24 need not be made of gold and may be made of a metal such as nickel and palladium which would provide a rectifying contact with a single-crystalline semiconductor of silicon or the like. Similarly, the deposition layer 25 need not be made of aluminum and may be made of a metal such as magnesium and indium which would provide a resistance contact with a single-crystalline semiconductor of silicon or the like.

The silicon substrate 23 need not be of n-type but may be of p-type. In this case, metals of the deposition layers 24 and 25 must be properly selected so that the rectifying contact and the resistance contact may be respectively provided.

The mode of operation of the semiconductor detector will now be described with reference to the case of the positive charged particle beam 20*a* among the beams 20*a* to 20*h*.

The positive charged particle beam 20 which is deflected by the momentum analyzer 7 in accordance with the momentum thereof contain particles of different masses. The beam 20*a* becomes incident on the semiconductor detector 22*a* with the momentum remaining the same. The semiconductor detector 22*a* generates an output pulse signal, the magnitude of which is proportional to the kinetic energy of the incident particles. This output pulse signal is amplified by the amplifier 27. The amplified signal is supplied to the pulse-height analyzer 28, for example, a multichannel-pulse-height analyzer which measures the pulse-height distribution. In this manner, the energy intensity distributions of charged particles can be determined which have the same momenta but different masses, hence, kinetic energies.

Figure 5:
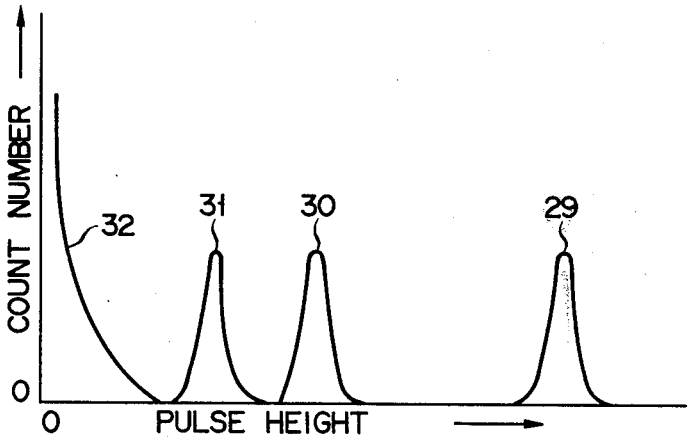
FIG. 5 is a graph showing a pulse-height distribution obtained with the analyzer shown in FIG. 3.

If the positive charged particle beam 20*a* contains the respective components of protons ($H^+$), deuterons ($D^+$) and tritons ($T^+$), the respective components have the same momenta but different masses. Thus, the kinetic energies of the respective components incident on the detector 22*a* are such that the kinetic energy of the deuterons is $\frac{1}{2}$ that of the protons, and the kinetic energy of the tritons is $\frac{1}{3}$ that of the protons. The pulse-height distribution of the output pulse signal obtained from the pulse-height analyzer 28 includes, as shown in FIG. 5, a pulse height 29 of the protons, a pulse height 30 of the deutrons, a pulse height 31 of the tritons and a pulse height 32 due to the noises of the detector and the amplifier. The intensity distribution of the kinetic energy of all kinds of the charged particles having different masses may thus be obtained from these pulse heights.

In practice, the detecting surface of the detector 22a has a certain area. Therefore, not only the charged particles having precisely the same momentum but also the charged particles having momenta within a certain range become incident on the detecting surface of the detector 22a. However, no particular problem occurs if this range of momenta is selected so that the peaks of the pulse heights of the output signals corresponding to the charge particles of different masses do not coincide in the pulse-height distribution curves.

By using a semiconductor energy analyzer comprising a plurality of semiconductor detectors 22a to 22h which are arranged in the paths of the charged particles deflected by the momentum analyzer 7, it is possible to simultaneously obtain the energy distributions for all kinds of charged particles having different masses over the same period of times.

The energy resolution of neutral particle analyzer depends upon the energy resolution inherent in each semiconductor detector, and the arrangement density of the semiconductor detectors within a certain area. The energy resolution inherent in each semiconductor detector must attain to a prescribed level so as to be able to convert the differences in the energies of the particles into differences in the pulse heights when the particles having different energies become incident on a single detector. With a surface barrier-type semiconductor detector, an excellent energy resolution is obtained. For example, when protons having a single energy of 30 keV become incident on such a detector, a full width at half maximum (FWHM) of the energy resolution is about 3 keV. Therefore, the analyzer of the present invention most effectively serves for analysis of neutral particle having high energy levels.

The detectors of the present invention are light in weight and compact in size and can be arranged at a high density within a limited space unlike in the case of the conventional arc-shaped energy analyzers. By arranging a number of such detectors in an array, a significantly higher energy resolution can be obtained than that obtainable with the conventional analyzer especially in cooperation with the high energy resolution inherent in the detectors of the present invention.

Although the neutral particle analyzer of the present invention may be most effectively utilized for the analysis of the neutral particles having a high energy level such as 30 keV, it may not fully exhibit its advantages for the analysis of the neutral particles having a low energy level such as several keV owing to an incident energy loss caused in the dead layer on the surface of the detector and a thermal noise caused by the amplifier connected to the detector. In such a case, the advantages of the analyzer of the present invention may be obtained if the charged particle beam from the momentum analyzer is accelerated.

A description will now be made of an accelerating means for accelerating the charged particle beam.

Figure 6:
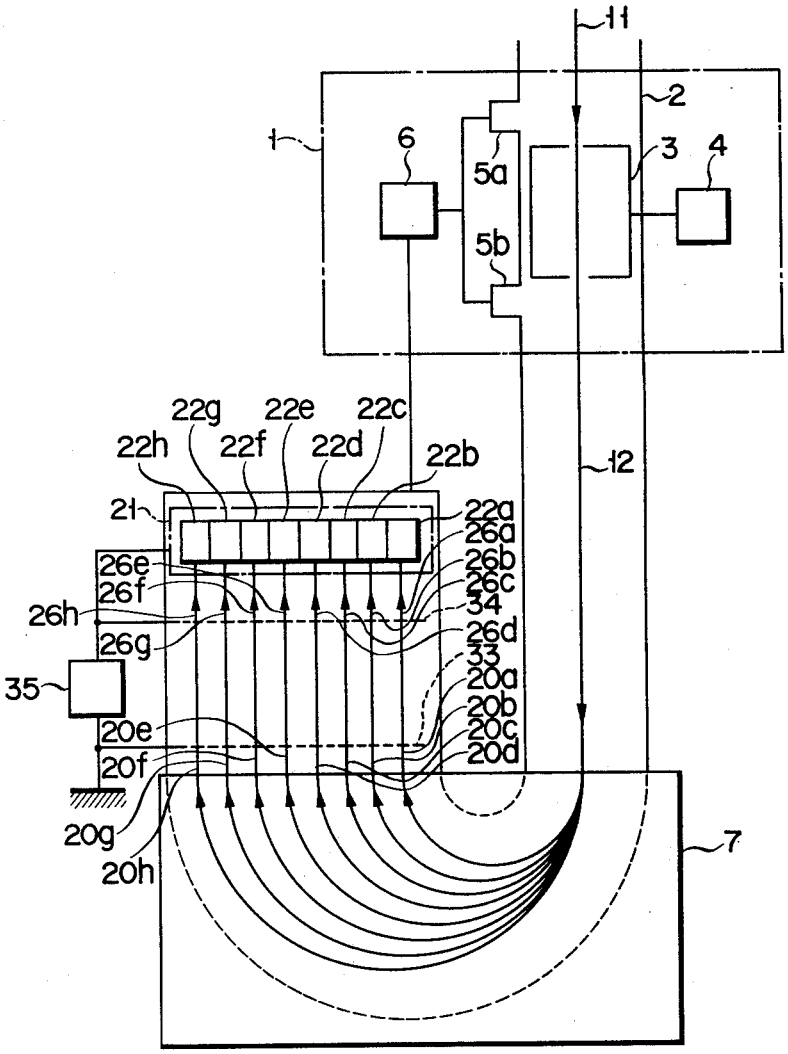
FIG. 6 is a schematic view showing the configuration of a neutral particle analyzer according to another embodiment of the present invention.

FIG. 6 shows a neutral particle analyzer having an accelerating means for accelerating the charged particle beam. Referring to FIG. 6, a pair of electrodes 33 and 34 are interposed between the momentum analyzer 7 and the semiconductor energy analyzer 21. The charged particles emerging from the momentum analyzer 7 become incident on the semiconductor energy analyzer 21 through the electrodes 33 and 34.

Figure 7:
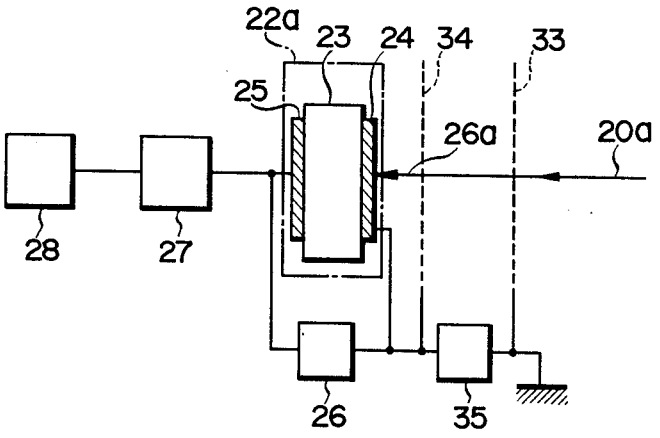
FIG. 7 is a view showing the configuration of a semiconductor detector and a pair of electrode plates of the analyzer shown in FIG. 6.

The electrode 34 is kept at a negative high potential with reference to the electrode 33 by a high-voltage power source 35. The semiconductor energy analyzer 21 is also kept at the same potential as that of the electrode 34 by the power source 35. Both these electrodes 33 and 34 preferably have network structure in order that an electrostatic field be applied between the electrodes 33 and 34 while allowing passage of the particle beams emerging from the momentum analyzer 7 therethrough. FIG. 7 shows the configuration of the semiconductor detectors 22a as an example of the plurality of silicon detectors constituting the semiconductor energy analyzer 21, and the configuration of the electrodes 33 and 34. The same reference numerals in FIG. 7 denote the same parts as in FIG. 4. A bias voltage is applied across the deposition layers 24 and 25 of the semiconductor detector 22 by the power source 26. The deposition layer 24 is kept at the same potential as that of the electrode 34 by the high-voltage power source 35. An output signal from the semiconductor detector 22a is supplied to the amplifier 27 and the pulse-height analyzer 28. Since the deposition layer 25 of the semiconductor detector 22a is kept at a high potential with respect to ground potential by the power sources 35 and 26, the amplifier 27 must have a structure so as to be able to isolate a dc voltage.

The mode of operation up to the generation of the pulse signals of the analyzer will now be described taking the beam 20a as an example among the positive charged particle beams 20a to 20h emerging from the momentum analyzer 7. The beam 20a which passes through the momentum analyzer 7 at the smallest radius of curvature has the lowest energy. Therefore, this may be considered as a reference for evaluating the performance of the neutral particle analyzer with the minimum energy detectable. If a surface barrier-type semiconductor detector is used as the charged particle detector, the minimum energy of an incident particle beam which may be detected is assumed to be about 5 to 6 keV when considering the energy loss of the charged particles at the dead layer on the surface of the detector and the thermal noise of the amplifier which is coupled to the detector. If an electrostatic field for accelerating the particles is applied between the momentum analyzer 7 and the detector 22a, it is possible to detect particles having energies lower than this minimum value which may not be detected with the semiconductor detector alone.

By biasing the electrode 33 to ground potential and the electrode 34 to $-V$ by the power source 35, an electrostatic field E given by equation (2) below is applied across the electrodes 33 and 34:

$$E=V/d \quad \ldots (2)$$

where d is a distance between the electrodes 33 and 34. With this electrostatic field E, the energy $\epsilon$ of a particle beam 20a after passing through the electrodes 33 and 34 may be given by equation (3) below:

$$\epsilon=\epsilon_0+q\cdot E\cdot d=\epsilon_0+qV \quad \ldots (3)$$

where $\epsilon_0$ is the energy of the particle beam 20a emerging from the momentum analyzer 7 and q is the charge of the particle beam emerging from the momentum analyzer 7. As may be seen from equation (3), the energy level of the particle beam 26a is higher than that of the particle beam 20*a* from the momentum analyzer 7 by the energy level caused by acceleration.

The voltage of the power source 35 need only be sufficient to apply an electric field which is capable of accelerating the energy of the charged particles to an energy slightly exceeding the lower limit of the energy detectable by the detector. A power source of 10 kV suffices when the semiconductor detector as described above is used. The semiconductor detector 22*a* is kept at the same potential as that of the electrode 34 for the purpose of preventing energy loss between the electrode 34 and the detector 22*a*.

As has been described above, since the semiconductor detector 22*a* generates output pulse signals proportional to the kinetic energy of the incident particles, the detection of the particles having different masses which are incident on the detector 22*a* is performed by utilizing the difference in the energies of the incident particles. For example if the beam 20*a* includes protons ($H^+$), deuterons ($D^+$) and tritons ($T^+$) as the charged particles, the energy of the deuterons is $\frac{1}{2}$ that of the protons, and the energy of the tritons is $\frac{1}{3}$ that of the protons. If the energies of the three kinds of ions are all high enough to allow detection by the semiconductor detectors, the pulse-height distribution may be obtained through detection by the detectors even if a voltage is not applied to the electrodes 33 and 34. The pulse-height distribution thus obtained includes, as shown in FIG. 5, the pulse height 29 of protons, the pulse height 30 of the deuterons which is $\frac{1}{2}$ the pulse height 29, the pulse height 31 of the tritons which is $\frac{1}{3}$ the pulse height 29, and the pulse height 32 due to the noises of the detector and the amplifier.

Figure 8:
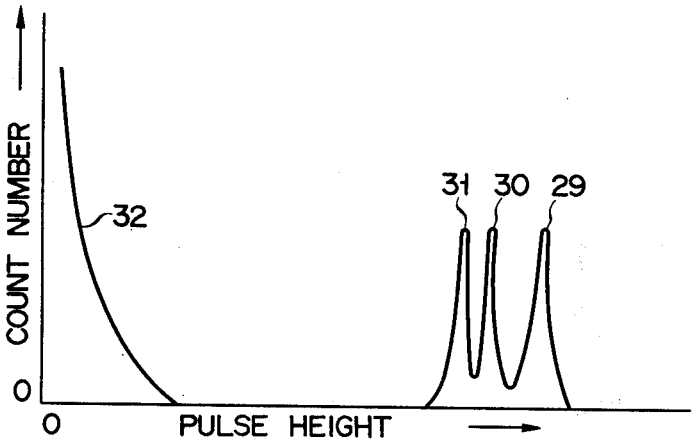
FIG. 8 is a graph showing a pulse-height distribution obtained with the analyzer shown in FIG. 6.

On the other hand, if the beam 20*a* emerging from the momentum analyzer has a low energy which does not allow detection by the semiconductor detector because of the pulse height 32, a voltage is applied to the electrodes 33 and 34 to accelerate the charged particles. The waveform of the output pulse signal after detection of the energy of the charged particles by the semiconductor detector becomes as shown in FIG. 8. Due to the acceleration by the electrostatic field, the proportions of the pulse heights 29, 30 and 31 of protons, deuterons and tritons do not become $1:\frac{1}{2}:\frac{1}{3}$. The lower limit of the energy which may be detected is determined by the particle beam 20*a* of the lowest energy which allows separation of pulse height according to the mass, as shown in FIG. 8. Although the lower limit of the energy of the beam which may be detected largely depends upon the performance of the semiconductor detector, it is considered to be a proton beam of about 1 keV.

In the embodiment shown in FIG. 6, the momentum analyzer 7 deflects the particle beam through 180°. This is for the purpose of converting the incident beam into parallel beams to facilitate uniform application of an electrostatic field. However, the momentum analyzer 7 is not limited to a type which deflects the beam through 180° and need not convert the incident beam into parallel beams. In the embodiment shown in FIG. 6, the electrostatic field is formed by the electrodes 33 and 34. However, it is possible, as a modification, to apply an electrostatic field without the use of the electrodes 33 and 34 by keeping the semiconductor energy analyzer 21 at a negative potential with reference to ground potential.

According to the neutral particle analyzer of the present invention shown in FIG. 6, it is possible to detect the neutral particles of low energy which have been hitherto impossible to detect with the detector shown in FIG. 3.

It is noted that the energy resolution may be improved by cooling the semiconductor detector with liquid nitrogen, dry ice, thermoelectronic cooling, or the like.

What we claim is:

1. A neutral particle analyzer comprising: ionization means for converting a neutral beam into a charged particle beam; momentum analyzing means for deflecting paths of respective charged particles of the charged particle beam emerging from said ionization means in correspondence with momenta thereof; and a semiconductor energy analyzer comprising a plurality of semiconductor detectors which are arranged in the paths of deflected charged particle beams emerging from said momentum analyzing means, said semiconductor energy analyzer generating pulse signals having pulse heights corresponding to masses of and kinetic energies of the deflected charged particles of the deflected charged particle beams.

2. A neutral particle analyzer according to claim 1, further comprising electrostatic field generating means for generating an electrostatic field for accelerating the deflected charged particle beam emerging from said momentum analyzing means.

3. A neutral particle analyzer according to claim 2, wherein said electrostatic field generating means comprises a first electrode which is kept at a potential same as a potential of said momentum analyzing means and which is arranged at the side of said momentum analyzing means, a second electrode which is arranged at the side of said semiconductor energy analyzer to oppose said first electrode and which is kept at a negative high potential with reference to said first electrode, and means for keeping the semiconductor energy analyzer at a potential same as a potential of said electrode.

4. A neutral particle analyzer according to claim 2, wherein said electrostatic field generating means comprises means for maintaining said semiconductor energy analyzer at a negative potential with reference to ground potential.

5. A neutral particle analyzer according to claim 1 or 2, further comprising an amplifier for amplifying the output pulse signals from said semiconductor detectors, and a pulse-height analyzer for measuring a pulse-height distribution of the amplified pulse signals.

6. A neutral particle analyzer according to claim 5, wherein said semiconductor detectors comprise surface barrier-type semiconductor detectors.

* * * * *